US005819321A

United States Patent [19]

Wang

[11] Patent Number: 5,819,321

[45] Date of Patent: Oct. 13, 1998

[54] DIVER'S MASK

[76] Inventor: Kenny Wang, No. 1, Sec. 4, Chung Hsin Rd., San Chung City, Taipei Hsien, Taiwan

[21] Appl. No.: 901,675

[22] Filed: Jul. 28, 1997

[51] Int. Cl.[6] ..... A61F 9/02

[52] U.S. Cl. ..... 2/428; 2/441

[58] Field of Search ..... 2/428, 430, 429, 2/441, 443, 440

[56] References Cited

U.S. PATENT DOCUMENTS

| | | | |
|---|---|---|---|
| 4,689,838 | 9/1987 | Angermann et al. | 2/441 |
| 5,564,132 | 10/1996 | Kuo | 2/441 X |
| 5,638,552 | 6/1997 | Fujima | 2/428 |

*Primary Examiner*—Peter Nerbun
*Attorney, Agent, or Firm*—Foley & Lardner

[57] ABSTRACT

A diver's mask has a body having a pair of symmetrically opposed first spaces defined therein, a cover detachably engaged with the body and having a pair of symmetrically opposed second spaces defined therein and respectively corresponding to the pair of first spaces, a pair of symmetrically opposed frames each detachable with and slidable onto the cover and a pair of symmetrically opposed lenses each detachably secured between the frame and the cover. Due to the slidable relationship between each of the frames and the cover, a user is able to save time assembling and disassembling elements and that the relationship between elements are able to maintain in a watertight manner.

3 Claims, 5 Drawing Sheets

DIVER'S MASK

FIELD OF THE INVENTION

The present invention generally relates to a diver's mask, and more particularly to a diver's mask which has lenses that are slidably fastened thereto through a respective track formed in a cover which is able to fit with a body of the diver's mask in a watertight manner.

BACKGROUND OF THE INVENTION

A conventional diver's mask, as shown in FIG. 5, comprises a body 50 having a pair of symmetrically opposed spaces (not numbered) each defined by a peripheral frame 501 thereof for respectively receiving a lens 51 therein and an adjustable head band (not numbered) securely connected and integrally formed with the body 50 for snugly and in a watertight manner fitting the diver's mask to a user's head. A top face of the frame 501 is configured to have a cutout 502 and a plurality of notches 503 are defined in an inner periphery thereof. A cover 53 provided to fit into the respective space of the body 50 has a plurality of protrusions 531 configured to correspond to the notches 503 and an extension 532 integrally formed thereon and corresponding to the cutout 502 of the body 50. After the lenses 51 are respectively disposed in each of the spaces of the body 50, insertion of the extension 532 into the cutout 502 and of the protrusions 531 into the notches 503 will secure the individual lens 51 within the respective space. The relationship between the extension 532 of the cover 53 and the cutout 502 of the body 50 is designed to hve a snap fit, such that when the lens 51 is secured within the space, it is in a watertight manner.

Another conventional type of diver's mask is shown in FIG. 6. The diver's mask also has a body 60 having a frame 601 integrally formed therewith, a single lens 61 having a size equal to or slightly smaller than that of the frame 601 and an adjustable cover 62. Due to a periphery of the frame 601 being surrounded by rubber or plastic, that when the lens 61 is disposed on the frame 601, the adjustable cover 62 is able to secure the lens 61 onto the frame 601 by a securing device (not numbered).

Both types of the diver's masks described above have their unique features and the disassembly and assembly of which are convenient for the users. However, after frequent usage of the diver's mask, the abutment between elements will become loose, which will lead to leakage within the diver's mask and that will spoil the fun of users. Furthermore, the snap fit between elements are easy to be broken if the diver's mask were to receive an impact.

From the previous description, it is noted that regardless of the large quantity of diver's masks in the market, alternatives and/or improvement(s) to those diver's masks are thus required. A diver's mask having a body, a cover fitted with the body, a pair of frames slidably and detachably connected with the cover and a pair of lenses securely abutted between the frame and the cover and constructed in accordance with the present invention tends to mitigate and/or obviate the aforementioned problems.

SUMMARY OF THE INVENTION

The main objective of the invention is to provide a diver's mask having a body, a cover fitted with the body, a pair of frames slidably and detachably connected with the cover and a pair of lenses securely abutted between the frame and the cover.

Another objective of the invention is to provide a securing device to further enhance the securement between the frame and the cover, such that even when the diver's mask receives an impact, due to the slidable relationship between elements, the invention is able to maintain elements in a watertight manner.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
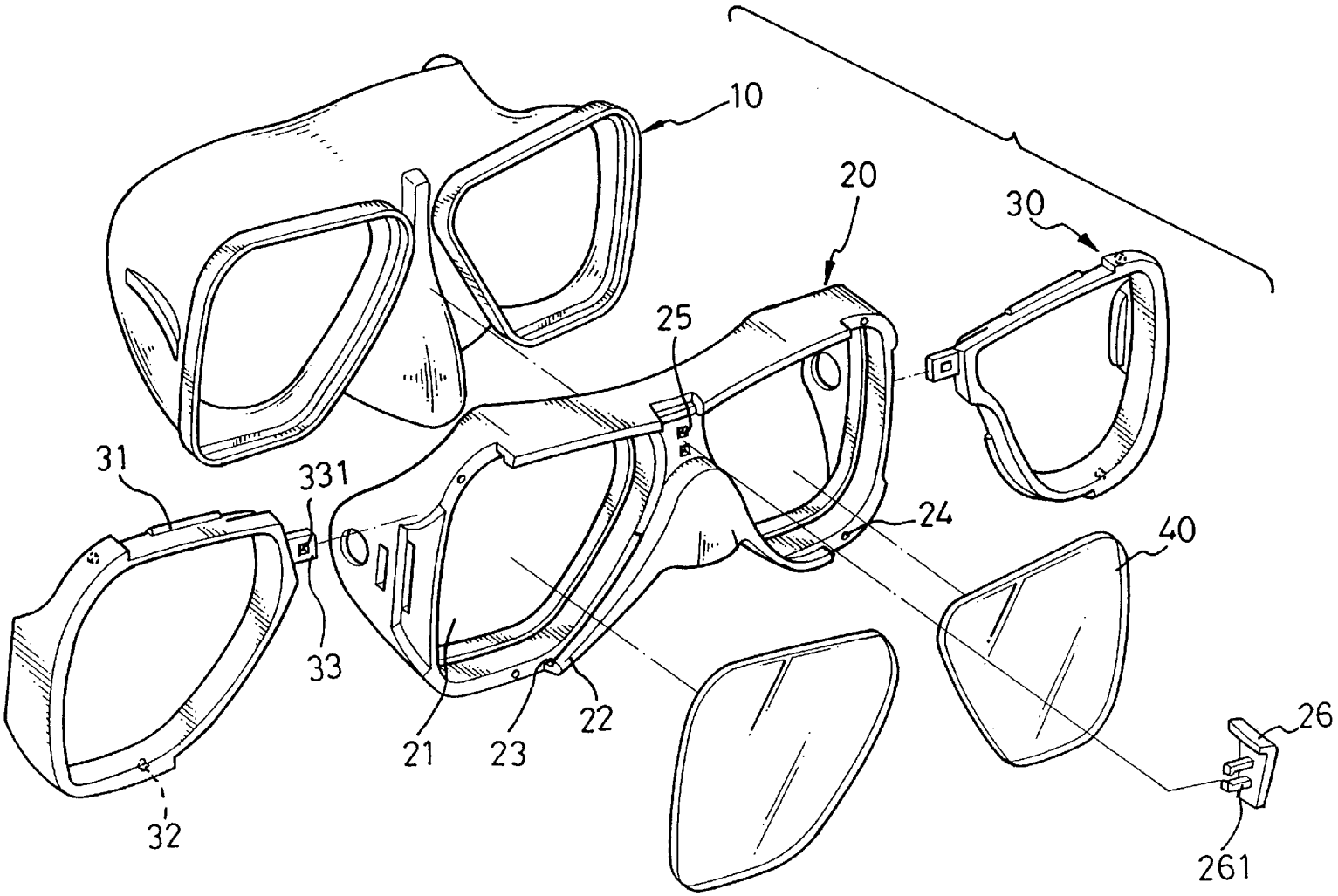
FIG. 1 is an exploded view of a preferred embodiment of the present invention.

Referring to FIG. 1, one preferred embodiment of a diver's mask of the present invention is shown. The embodiment intends in descriptive purpose and not in any form to limit the scope of the present invention, such that the features of the present invention also apply to various forms of diver's masks having the features described below.

In the preferred embodiment of FIG. 1, the diver's mask comprises a body 10 having defined therein a pair of symmetrically opposed first spaces 11, a cover 20 having defined therein a pair of symmetrically opposed second spaces 21 corresponding to the first spaces 11, a pair of symmetrically opposed frames 30 detachably and slidably received within the cover 20, a pair of lenses 40 each securely abutted to a periphery of the respective second spaces 21 by the respective frame 30 and a securing device 26 provided to further enhance the securement of the frames to the cover 20.

Figure 2:
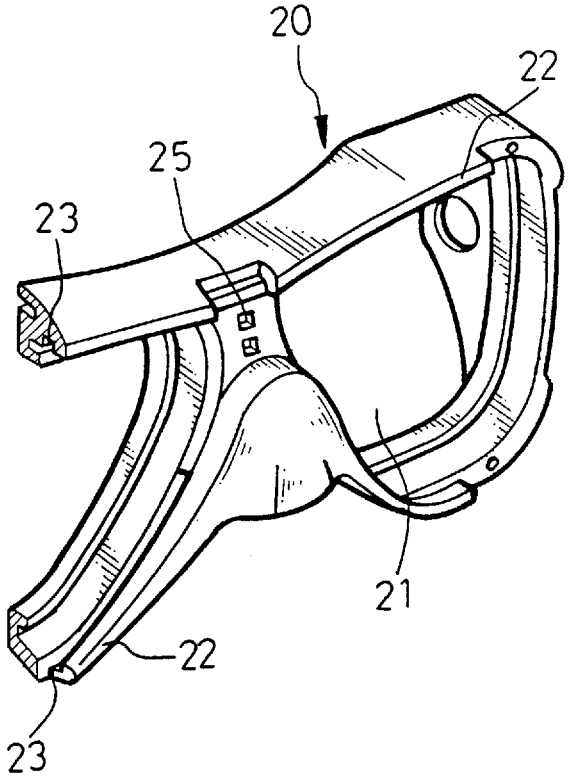
FIG. 2 is a perspective view of a cover partly in cross section.
Figure 3:
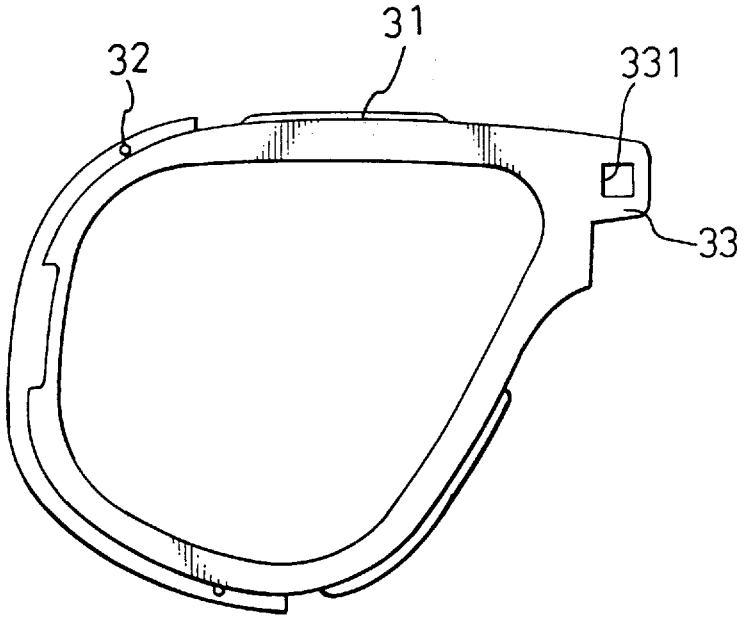
FIG. 3 is a bottom plane view of the cover.
Figure 4:
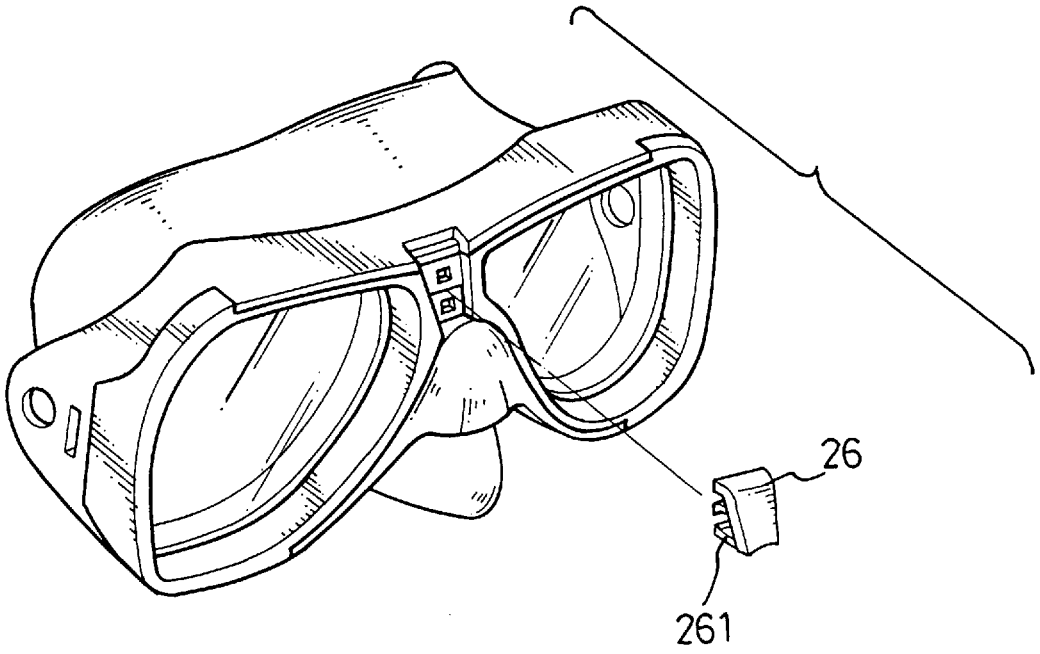
FIG. 4 is a perspective view showing that a securing device is provided to further enhance the securement between the cover and the frame.
Figure 5:
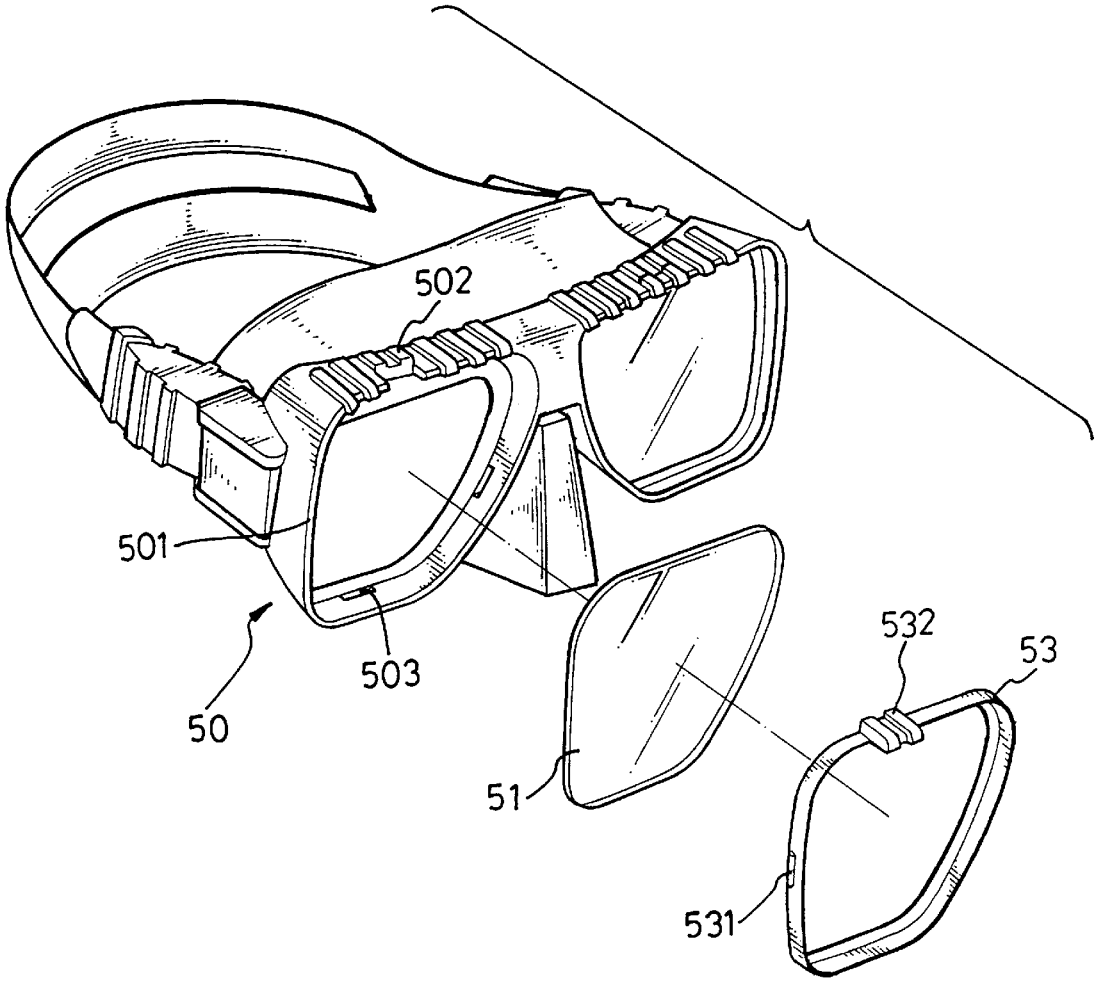
FIG. 5 PRIOR ART
FIG. 5 is a perspective view of a conventional diver's mask.
Figure 6:
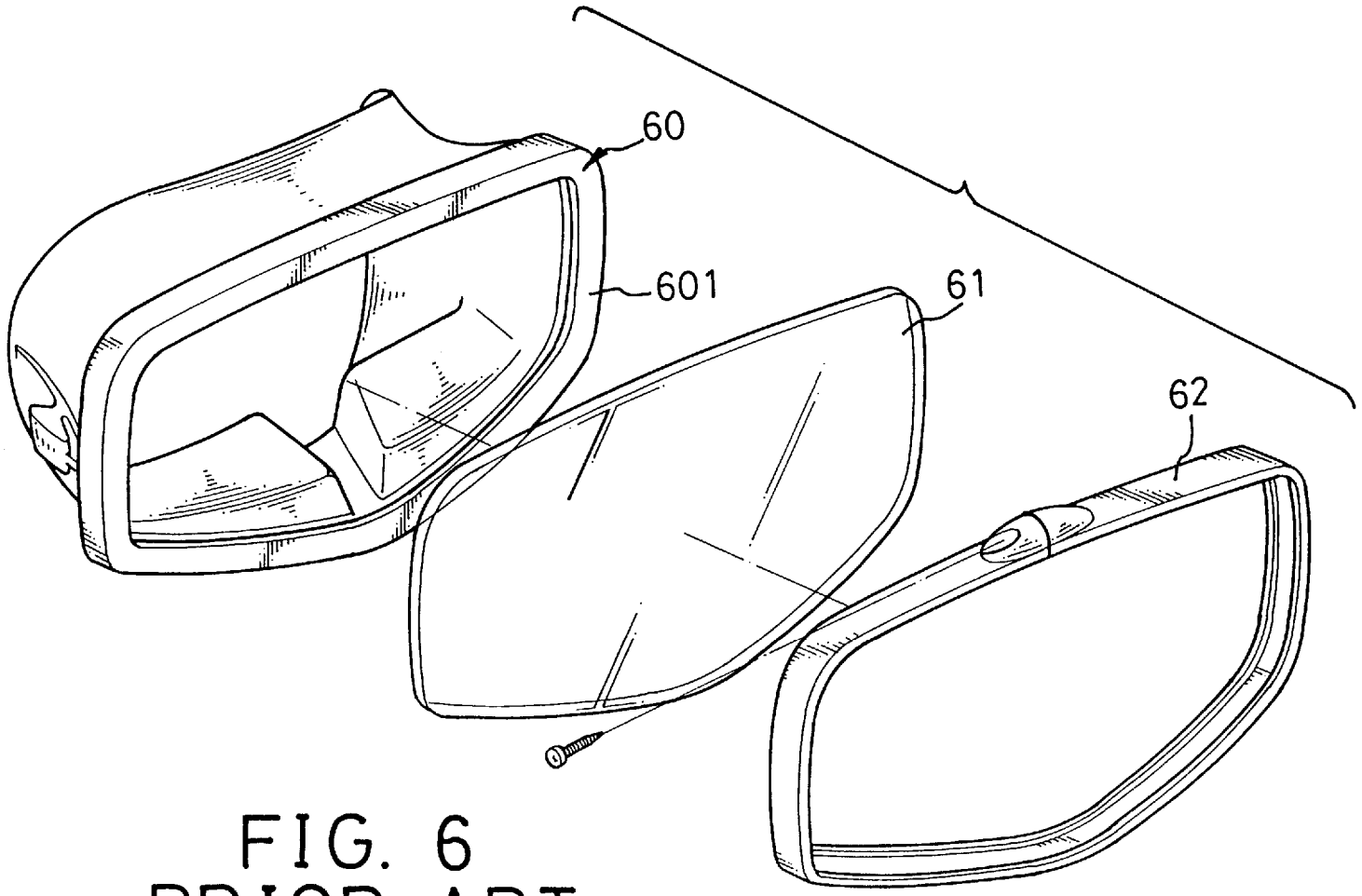
FIG. 6 PRIOR ART
FIG. 6 is an exploded view of a conventional diver's mask.

Referring again to FIG. 1 and taking FIGS. 2, 3 and 4 for reference, a flange 22 is integrally formed along a portion of a respective periphery of the pair of opposed second spaces 21, and a respective one of two tracks 23 is defined between the flange 22 and the corresponding periphery of the opposed second spaces 21. Furthermore, at least one position hole 24 is defined along the periphery of the opposed second space 21. Each frame 30 is configured and sized to correspond to the respective opposed second space 21 and is integrally provided with an extension 31 respectively along a top face and a bottom face thereof, so that each one of the frames 30 is able to slide along the respective track 23 of the cover 20 via the insertion of the extension 31 into the track. In addition, each of the frames 30 has at least one protrusion 32 corresponding to the position hole 24 of the cover 20 and which is formed along the periphery thereof, and a position block 33 with a through hole 331 defined therein. The position block 33 is integrally formed on a side face of the frame 30 and is opposed to the other position block 33 of the other frame 30. The position and height of where each of the position blocks 33 is formed is not necessarily symmetrically the same. The embodiment shown in FIG. 1 indicates that the each of the position blocks 33 is not formed at the same height and position, which consequently enables each position blocks 33 to be mated with at least one of two holes 25 defined in the cover 20 and provided between the opposed second spaces 21. The correspondence of the protrusion 32 to the position hole 24 and of the position block 33 to the hole 25 is that when an alignment between the position block 33 and the hole 25 is reached, the protrusion 32 is able to be inserted into the position hole 24. It is to be noted that since all the material used to make the diver's mask is either rubber or plastic or both, therefore, it is easy to have elements assembled in a watertight manner, therefore, when both of the pair of lenses 40 are respectively disposed around the periphery of each of the second space 21 of the cover 20, the sliding of the frame 30 onto the cover 20 via the extension 31 and the track 23 and the positioning effect provided by the insertion of the protrusion 32 into the position hole 24 will then hold the lenses 40 between the frame 30 and the cover 20 in a watertight manner.

When the lenses 40 are secured, and the through holes 331 of both the position blocks 33 are aligned with the holes 25 of the cover 20, a securing device 26 is provided to assemble the frame 30 onto the cover 20. The securing device 26 has at least two barbs 261 integrally formed and extended toward each other, so that when the through holes 331 of the frames 33 are aligned with the holes 25 of the cover 20, the insertion of the barbs 261 of the securing device 26 into the through holes 331 and the holes 25 will further secure the lenses 40 between the frames 30 and the cover 20.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A diver's mask comprising:

a body having a pair of symmetrically opposed first spaces defined therein;

a cover detachably fitted with said body in a watertight manner and having a pair of symmetrically opposed second spaces defined therein and corresponding to said first spaces of said body, a flange integrally formed between said pair of opposed second spaces and along a portion of a periphery defining each of said opposed second spaces, a track defined between said flange and said periphery of each of said opposed second spaces, at least one position hole defined along said periphery of each of said second spaces and at least two holes defined between said opposed second spaces;

a pair of symmetrically opposed frames each having an extension integrally formed on a top face and a bottom face thereof for being slidably received within said track, and at least one protrusion formed on a periphery thereof and detachably received within said position hole of said cover;

a pair of symmetrically opposed lenses respectively and detachably disposed on said periphery of said second space; and a securing device for securing said pair of frames onto said cover.

2. A diver's mask as claimed in claim 1, wherein each of said frames further has a position block integrally extending out from a side face thereof and having a through hole defined therein for alignment with one of said holes of said cover.

3. A diver's mask as claimed in claim 1, wherein said securing device further has at least two barbs for respectively inserting into a through hole of each of said frames and into holes of said cover.

* * * * *